US006672410B2

(12) United States Patent
Smith

(10) Patent No.: US 6,672,410 B2
(45) Date of Patent: Jan. 6, 2004

(54) DRILLING MACHINE HAVING A FEED CABLE TENSIONER

(75) Inventor: Donald W. Smith, Garland, TX (US)

(73) Assignee: Ingersoll-Rand Company, Woodcliffe Lake, NJ (US)

( * ) Notice: Subject to any disclaimer, the term of this patent is extended or adjusted under 35 U.S.C. 154(b) by 38 days.

(21) Appl. No.: 09/962,476

(22) Filed: Sep. 25, 2001

(65) Prior Publication Data

US 2003/0056993 A1 Mar. 27, 2003

(51) Int. Cl.[7] ..... E21B 15/00

(52) U.S. Cl. ..... 175/122; 175/162; 175/203; 175/220

(58) Field of Search ..... 175/122, 162, 175/203, 220

(56) References Cited

U.S. PATENT DOCUMENTS 3,894,582 A * 7/1975 Kammerer ..... 166/5
4,421,173 A 12/1983 Beakley et al.
4,858,694 A 8/1989 Johnson et al.
5,368,112 A 11/1994 Mount et al.
6,112,834 A 9/2000 Barrett
6,257,349 B1 * 7/2001 Bardwell ..... 173/28

* cited by examiner

*Primary Examiner*—David Bagnell
*Assistant Examiner*—Giovanna M. Collins
(74) *Attorney, Agent, or Firm*—Michael Best & Friedrich LLP

(57) ABSTRACT

The drilling machine includes a frame that is supported for movement over the ground and a tower that is mounted on the frame. A rotary head is movable along the tower and engageable with a drill string for rotating the drill string. A pull down cable is connected to the rotary head for pulling the rotary head downward for pushing the drill string into the ground. A pull back cable is connected to the rotary head for pulling the rotary head upward for pulling the drill string out of the ground. The pull back cable is subject to a slack condition in response to elastic stretch of the pull down cable. A slack take-up device is connected to the pull back cable to remove the slack created in the pull back cable by the elastic stretch of the pull down cable.

18 Claims, 15 Drawing Sheets

DRILLING MACHINE HAVING A FEED CABLE TENSIONER

FIELD OF THE INVENTION

The invention relates to drilling machines, and more particularly, to drilling machines having a feed cable tensioner.

BACKGROUND OF THE INVENTION

Drilling machines typically include a frame, a tower, and a rotary head. The frame is supported for movement over the ground, and the tower is mounted on the frame. The rotary head is movable along the tower and engageable with the drill string for rotating the drill string.

Feed cable systems are connected to the rotary head to position and direct forces to the rotary head and drill string during drilling operations. For example, the feed cable system moves the rotary head downward to force the rotating drill string into the ground to drill a hole and upward to raise the drill string out of the drilled hole.

The feed cable system includes a cable and pulley assembly that is connected to an actuator. Movement of the actuator in a first direction applies tension to a pull down cable to provide a downward force on the rotary head and movement of the actuator in the opposite direction applies tension in a pull back cable to provide an upward force on the rotary head. Feed cable systems have many advantages over other systems, however, the cables of the feed cable system stretch under load. Further, the pull down and pull back cables on known the cable system are configured such that cable stretch in one of the cables caused by the tension applied to the cable results in a corresponding slack in the other cable.

Slack experienced in the cables is disadvantageous because loose cables in a cable and pulley system are likely to disconnect from the pulleys and cause the cable to whip from the pulley when a tension is reapplied to the loose cable. In addition to requiring immediate maintenance to repair the feed cable system, cable whip is capable of causing injury to vehicle operators and damage to surrounding equipment on the drilling machine.

SUMMARY OF THE INVENTION

The feed cable system of the present invention prevents loose pullback cables by including take-up cylinders that remove slack from the pullback cables when the pull down cables experience elastic stretch. The take-up cylinders increase the safety of the operation of the drilling machine because loose cables have the potential to disconnect from pulleys and sheaves which could cause substantial damage to surrounding equipment from cable whip.

One embodiment of the present invention is directed to a drilling machine for use with a drill string. The drilling machine also includes a pull down cable, a pull back cable, and a slack take-up device. The pull down cable is connected to a rotary head for pulling the rotary head downward relative to a tower for pushing the drill string into the ground. The pull back cable connected to the rotary head for pulling the rotary head upward relative to the tower for pulling the drill string out of the ground. The pull back cable is subject to a slack condition in response to elastic stretch of the pull down cable. The slack take-up device is connected to the pull back cable to remove the slack created in the pull back cable by the elastic stretch of the pull down cable.

Other features and advantages of the invention will become apparent to those skilled in the art upon review of the following detailed description, claims, and drawings.

BRIEF DESCRIPTION OF THE DRAWINGS

FIGS. 17–21 are enlarged perspective views illustrating the non-impact breakout system shown in FIG. 14.

Figure 1:
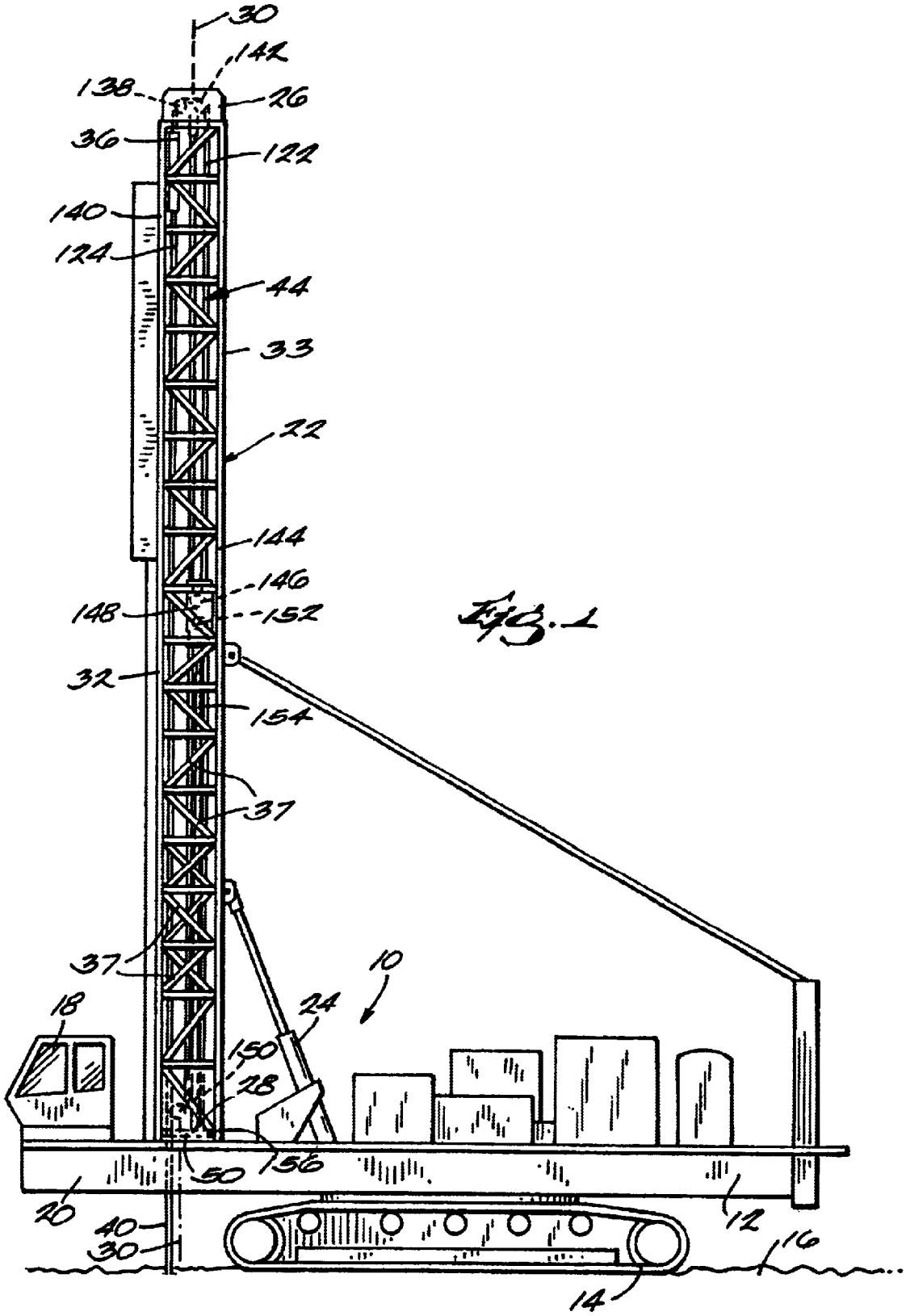
FIG. 1 is a side view illustrating a drilling machine embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

FIG. 1 illustrates a drilling machine 10 embodying the present invention. The drilling machine 10 includes a frame 12 that is supported by crawlers 14 for movement above the ground 16. The drilling machine 10 includes an operator station 18 located on the front 20 of the frame 12 and a tower 22 pivotally mounted on the frame 12. The tower 22 is sometimes referred to as a derrick or mast and is movable relative to the frame 12 between a substantially vertical position and a non-vertical position by a tower lift cylinder 24. Varying the position of the tower 22 varies the angle of drilling, as is known in the art. The top 26 of the tower 22 is generally referred to as the crown and the bottom 28 of the tower 22 is generally referred to as the tower base. The tower 22 defines a longitudinal axis 30 and includes two forward elongated members 32, 34, or chords, and two rearward chords 33, 35 (see FIG. 14). The chords 32, 33, 34, 35 are connected together and supported by truss members 37 along the tower. The chords 32, 34 extend in a direction parallel to the longitudinal axis 30 and are separated by a distance D measured perpendicular to the longitudinal axis 30 (see FIG. 2). Both chords 32, 34 have square-shaped cross-sections, and each chord 32, 34 includes a forward face 80, an opposite rearward face 82, and an interior side face 84 that is in facing relation with the other chord 32, 34 (see FIG. 4).

The drilling machine 10 includes a rotary head 36 and rotary head guides 38. The rotary head guides 38 are connected to the rotary head 36 and are slidably coupled to respective chords 32, 34. The rotary head 36 is engageable with a drill string 40 and includes a motor (not shown) that rotates the drill string 40. The drill string 40 includes multiple drill rods 42 connected in series to form a desired length. The drill string 40 extends downward from the rotary head 36, through the frame 12, and toward, or into the ground 16. The drilling machine 10 also includes a feed cable system 44 that moves the rotary head 36 along the tower 22. As the rotary head 36 rotates, the feed cable system 44 moves the rotary head 36 downward to force the drill string 40 into the ground 16 in order to bore or drill a hole into the ground 16. The rotary head guides 38 properly align the rotary head 36 with the tower 22 and counteract the torque forces transferred to the rotary head 36 during operation of the drilling machine 10. The feed cable system 44 also moves the rotary head 36 upwardly to remove the drill string 40 from the ground 16.

The drill string 40 is assembled by drilling a first drill rod 42 (see FIG. 17) into the ground 16 until the rotary head 36 is completely lowered. Next, the rotary head 36 is disconnected from the first drill rod 42 and raised to the top 26 of the tower 22 where a second, upper drill rod 42A (see FIG. 17) is connected to the rotary head 36 and to the first, lower drill rod 42B. The addition of more drill rods 42 to the drill string 40 can be accomplished in a similar manner to obtain a drill string 40 capable of reaching the desired depth of the hole to be drilled. The drill rods 42 have mating threaded ends 46 that are connected together by turning the rotary head 36 in a forward, drilling direction to form a joint 48 between drill rods 42. Except for the lowest drill rod 42, which includes a drill point at its lowest end, each drill rod 42 includes external threads at one end and internal threads at the other end such that the drill rods 42 can be threaded together to form the drill string 40.

The drill string 40 is disassembled by raising the rotary head 36 to the top 26 of the tower 22 and disconnecting the exposed upper drill rod 42A from the adjacent lower drill rod 42B with a non-impact breakout system 50, if necessary, located near the base of the tower 22. The non-impact breakout system 50 breaks the threaded joint 48 between the upper and lower drill rods 42A, 42B such that the upper drill rod 42A can be removed from the rotary head 36 and the drill string 40. The rotary head 36 is then lowered and connected to the upper end of the remaining lower drill rod 42B and the procedure is repeated until the entire drill string 40 is removed.

Figure 2:
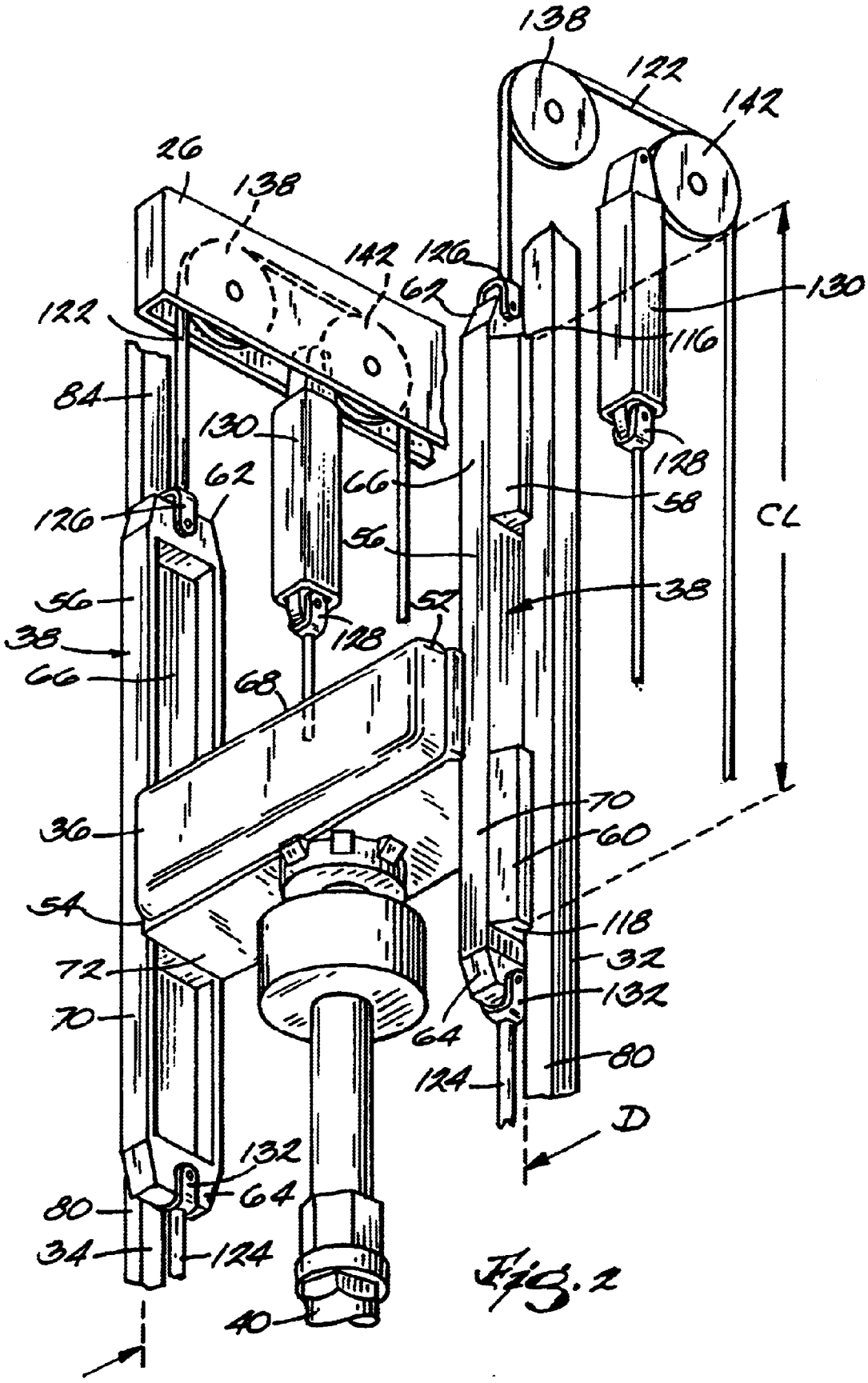
FIG. 2 is an enlarged perspective view illustrating the rotary head guides of the drilling machine shown in FIG. 1.
Figure 3:
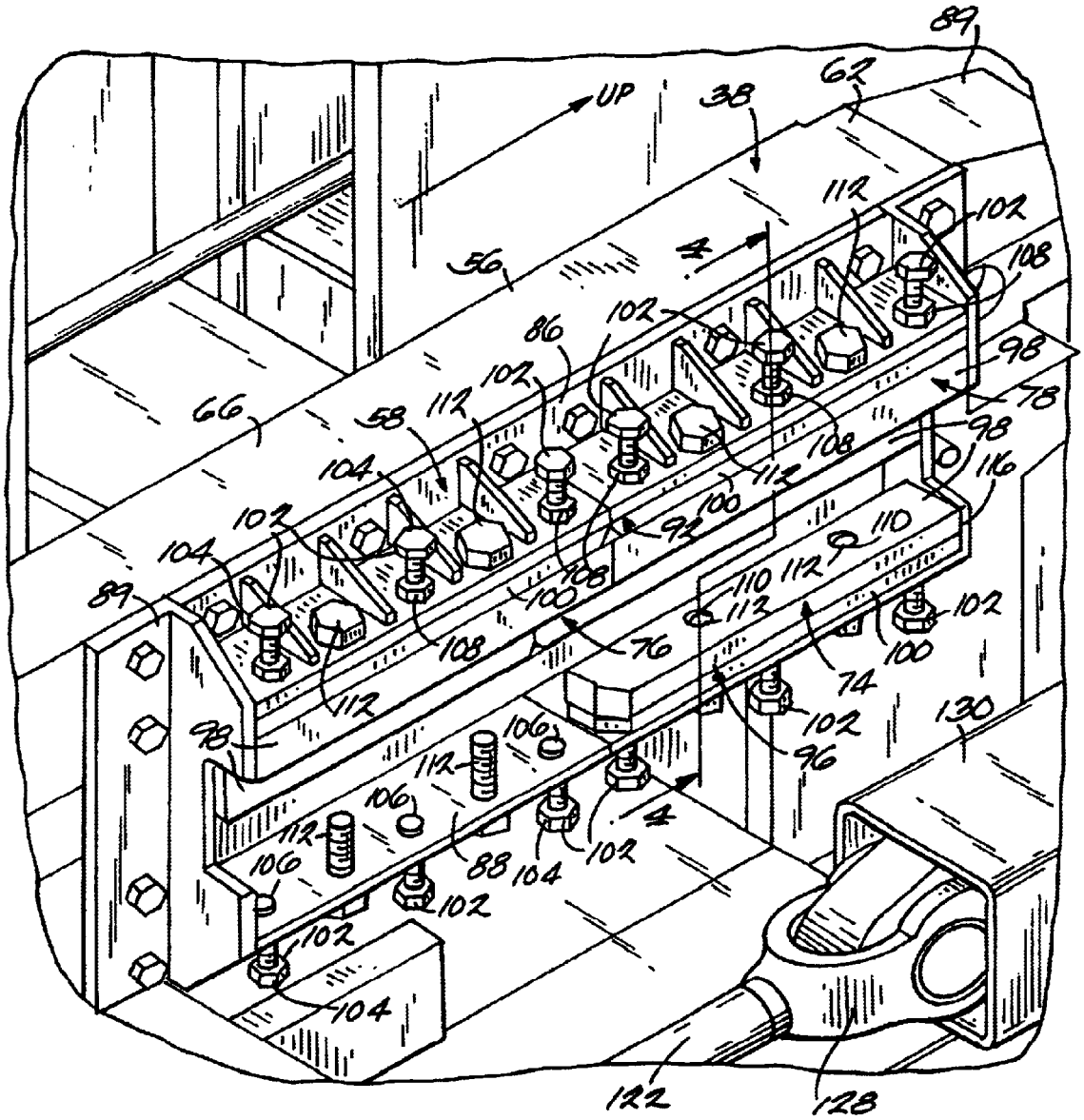
FIG. 3 is a an enlarged view illustrating the rotary head guide shown in FIG. 2 partially disassembled.

As best illustrated in FIG. 2, the first rotary head guide 38 is coupled to one side 52 (right side in FIG. 2) of the rotary head 36 and the second rotary head guide 38 is coupled to the opposite side 54 (left side in FIG. 2) of the rotary head 36. The first rotary head guide 38 is a mirror image of the second rotary head guide 38, and therefore, only the first rotary head guide 38 will be described in detail with further reference to FIGS. 3 and 4. FIG. 3 is an enlarged perspective view of a partially disassembled rotary head guide 38 with the chord 32 removed.

The first rotary head guide 38 includes a support 56 and first and second or upper and lower wear assemblies 58, 60 mounted to the support 56 (see FIG. 2). The support 56 extends parallel to the longitudinal axis 30 and is centrally connected to the side 52 of the rotary head 36. Upper and lower ends 62, 64 of the support 56 are connected to the feed cable system 44 that provides the force necessary to move the rotary head 36 along the tower 22. The wear assembly 58 is positioned on an upper portion 66 of the support 56 and above an upper surface 68 of the rotary head 36 and the wear assembly 60 is positioned on a lower portion 70 of the support 56 and below a lower surface 72 of the rotary head 36. The wear assemblies 58, 60 are similarly constructed, therefore, the configuration of only the upper wear assembly 58 will be described in detail.

Figure 4:
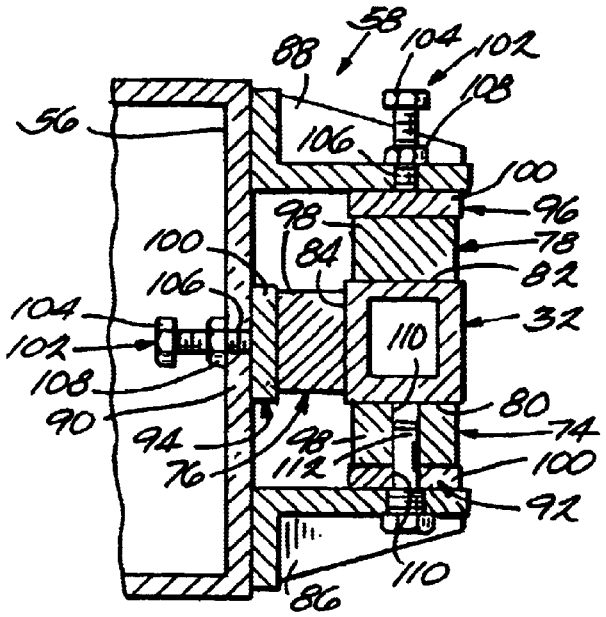
FIG. 4 is a cross section view taken along line 4—4 in FIG. 3.

With further reference to FIGS. 3 and 4, the wear assembly 58 includes first, second, and third sets 74, 76, 78 of wear blocks 98 that slidably engage with the three respective faces 80, 82, 84 of the chords 32. The sets 74, 76, 78 of blocks 98 of the other rotary head guide 38 similarly engage the faces 80, 82, 84 of the chord 34. The first set 74 of wear blocks 98 engage the forward face 80 of the first chord 32, the second set 76 of wear blocks 98 engage the side face 84 of the first chord 32, and the third set 78 of wear blocks 98 engage the rearward face 82 of the first chord 32.

The support 56 includes a forward bracket 86 that is in facing relation with the forward face 80 of the first chord 32. The support 56 also includes a rearward bracket 88 that is in facing relation with the rearward face 82 of the first chord 32. End brackets 89 are connected to the support 56 and abut against the ends of the forward and rearward brackets 86, 88. The support 56 includes a central, longitudinally extending mounting portion 90 that is located between the forward and rearward brackets 86, 88 and that is in facing relation with the side face 84 of the first chord 32.

The wear assembly 58 includes sets 92, 94, 96 of backing bars 100 that are positioned between respective sets 74, 76, 78 of wear blocks 98 and the support 56 or brackets 86, 88. Specifically, a first set 92 of backing bars 100 are coupled between the first set 74 of wear blocks 98 and the forward bracket 86, a second set 94 of backing bars 100 are coupled between the second set 76 of wear blocks 98 and the mounting portion 90 of the support 56, and a third set 96 of backing bars 100 are coupled between the third set 78 of wear blocks 98 and the rearward bracket 88.

Each set 74, 76, 78 of wear blocks 98 and each respective set 92, 94, 96 of backing bars 100 include two separate wear blocks 98 positioned in an end to end relationship in a direction parallel to the longitudinal axis 30 and two respective and separate backing bars 100 positioned in an end to end relationship in a direction parallel to the longitudinal axis 30. Only one respective combination including one wear block 98 and one respective backing bar 100 will be described in relation to the mounting portion 90 of the support 56. It should be noted that four of the six wear block/backing bar combinations on each wear assembly 58, 60 are actually mounted to the brackets 86, 88 of the support 56 and not to the mounting portion 90 of the support 56 as will be described below.

Three adjustment mechanisms 102 are coupled to the mounting portion 90 of the support 56 and engage the backing bar 100 such that adjustment of the adjustment mechanisms 102 moves the backing bar 100 away from the support 56 to move the wear block 98 against the chord 32. In the illustrated embodiment, the adjustment mechanisms 102 are bolts 104 that extend through threaded holes 106 in the support 56 (see FIG. 4) such that rotation of the bolts 104 in clockwise direction extends the bolts 104 through the support 56 and moves the backing bar 100 away from the support 56. Rotation of the bolts 104 in a counterclockwise direction retracts the bolts 104 and allows a larger gap between the backing bar 100 and the side face 84 of the chord 32. The illustrated embodiment also includes a lock nut 108 that is threaded on each bolt 104 on the side of the support 56 that is opposite to the backing bar 100 such that when each bolt 104 has been correctly adjusted, the lock nut 108 can be tightened against the support 56 to prevent each bolt 104 from turning, thereby fixing the minimum distance between the backing bar 100 and the support 56.

The wear block 98 and the backing bar 100 each include a pair of spaced apart apertures 110 that extend in a direction that is perpendicular to the longitudinal axis 30. Two guide studs 112 are connected to the support 56 and extend through the respective apertures 110 in the wear block 98 and the backing bar 100 to maintain the alignment of the wear block 98 and the backing bar 100 relative to the support 56 and each other.

During operation of the drilling machine 10, the wear blocks 98 experience excessive wear against the chords 32, 34 and, in turn, large gaps are created between the wear blocks 98 and the chords 32, 34. These gaps allow misalignment of the rotary head 36, and misalignment of the drill rods 42 when attempting to connect drill rods 42 to create a drill string 40. The operator eliminates these gaps and maintains proper spacing between the wear blocks 98 and the chords 32, 34 by occasionally adjusting the adjustment mechanisms 102 to ensure proper spacing between the wear blocks 98 and the chords 32, 34. Specifically, the adjustment mechanisms 102 are adjusted to move the wear blocks 98 against the chords 32, 34 to eliminate the large gaps due to operation wear.

As shown in FIG. 2, the rotary head guides 38 each include a contact length CL. The contact length CL is defined by the distance between the top end 116 of the uppermost wear block 98 of the wear assembly 58 and the bottom end 118 of the lowermost wear block 98 of the wear assembly 60. This contact length CL is the same for both rotary head guides 38 and is greater than the distance between the chords 32, 34. Due to the increased contact length CL, the rotary head guides 38 improve the alignment of the rotary head 36.

In addition, it is more convenient to replace and maintain the wear assemblies 58, 60 of the rotary head guides 38 because a crane is not required to support the rotary head 36 during the repair of the wear assemblies 5–60. The rotary head guide 38 eliminates the need for a crane to support the rotary head 36 during maintenance by providing a second set of wear assemblies 58, 60 connected to the supports 56 so that one set of wear assemblies 58, 60 can be replaced or adjusted while the second set of wear assemblies 58, 60 support the rotary head 36 by coupling to the chords 32, 34.

Figure 5:
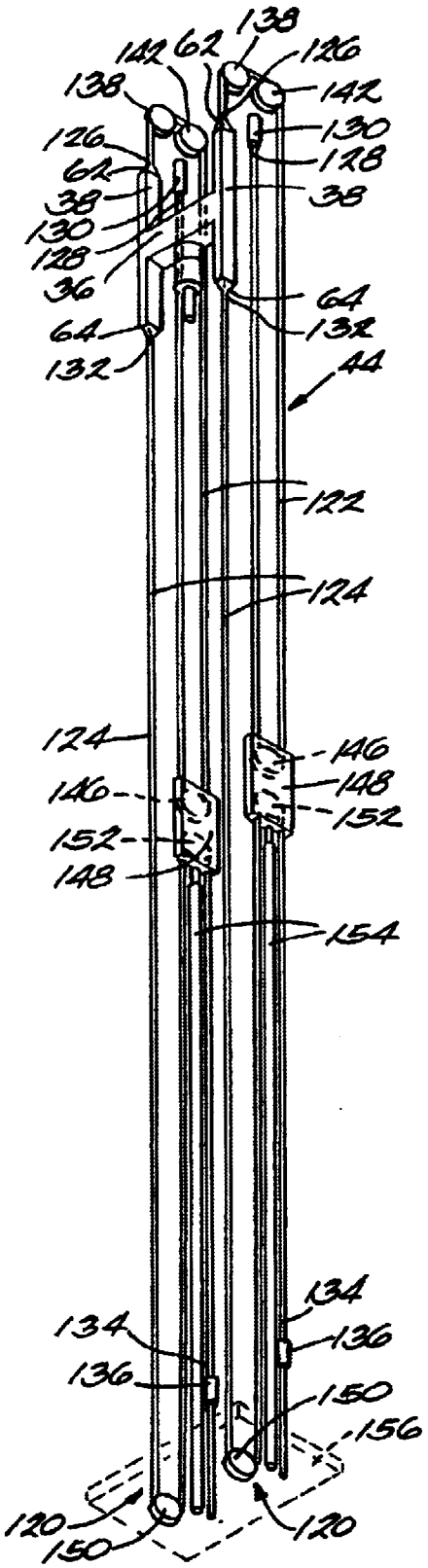
FIG. 5 is a perspective view illustrating a feed cable system of the drilling machine shown in FIG. 1 with the rotary head in the raised position.

FIG. 5 illustrates the feed cable system 44 with the rotary head 36 in the raised position. The feed cable system 44 of the drilling machine 10 includes two feed cable subsystems 120 that are similarly constructed on each side of the rotary head 36. Accordingly, only one such subsystem 120 will be described in detail below. The feed cable subsystem 120 includes a pull back cable 122 that pulls the rotary head 36 upward and a pull down cable 124 that pulls the rotary head 36 downward along the tower 22. The pull back cable 122 includes a first end 126 that is connected to the upper end 62 of the support 56 of the rotary head guide 38 and a second end 128 that is connected to the top 26 of the tower 22 through a slack take-up device 130. The pull down cable 124 includes a first end 132 that is connected to the lower end 64 of the support 56 of the rotary head guide 38 and a second end 134 that is connected to the bottom 28 of the tower 22 through a take up device 136.

The feed cable subsystem 120 includes a first pull back pulley 138 that is rotatably connected to the forward portion 140 of the top 26 of the tower 22, a second pull back pulley 142 that is rotatably connected to the rearward portion 144 of the top 26 of the tower 22, and a third pull back pulley 146 rotatably connected to a pulley support member 148 that is movable relative to the tower 22. The feed cable subsystem 120 also includes a first pull down pulley 150 rotatably connected to the forward portion 140 of the bottom 28 of the tower 22 and a second pull down pulley 152 rotatably connected to the pulley support member 148 at a position that is lower than the third pull back pulley 146. The pull back cable 122 extends from the upper end 62 of the support 56 and reeves around the pull back pulleys 138, 142, 146 consecutively before connecting to the slack take-up device 130. The pull down cable 124 extends from the lower end 64 of the support 56 and reeves around the pull down pulleys 150, 152 consecutively before connecting to the take up device 136.

Figure 6:
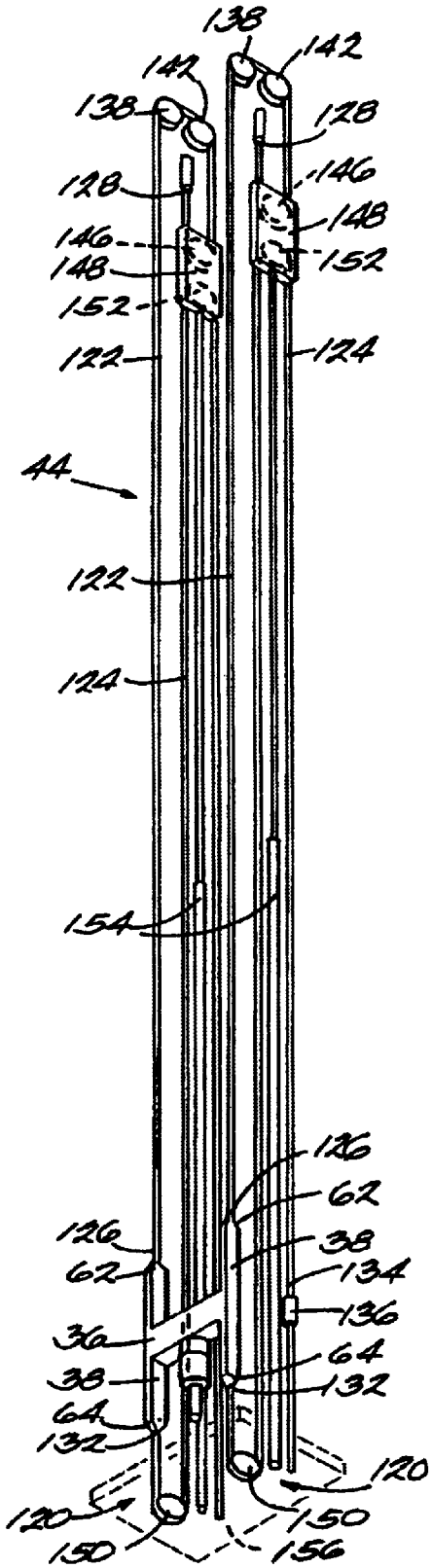
FIG. 6 is a perspective view illustrating the feed cable system shown in FIG. 5 with the rotary head in the lowered position.
Figure 7:
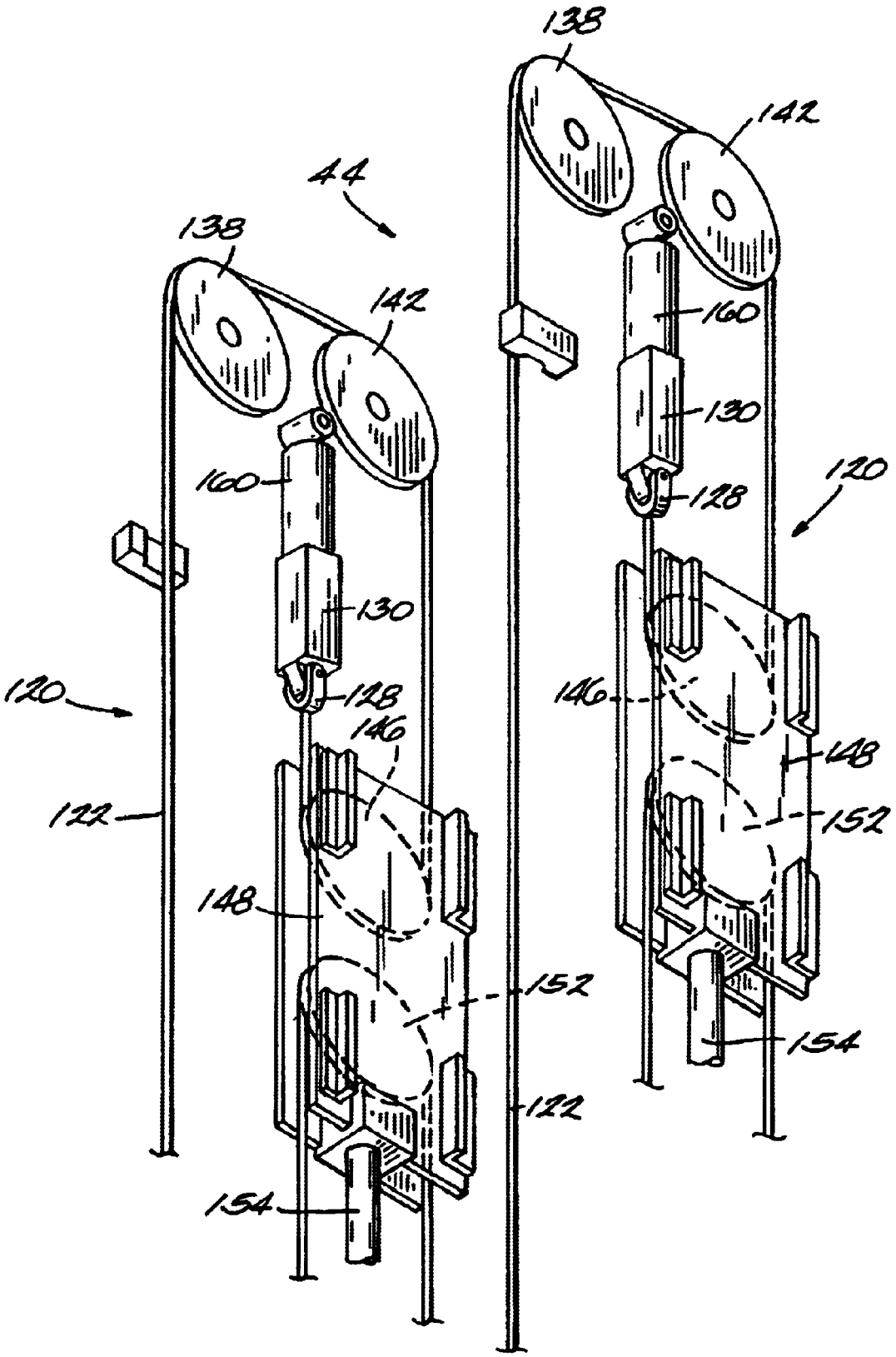
FIG. 7 is an enlarged perspective view illustrating an upper portion of the feed cable system shown in FIG. 6.

With further reference to FIGS. 6 and 7, the feed cable subsystem 120 includes a linear motor 154 that is connected between the pulley support member 148 and a deck 156 that is connected to the bottom 28 of the tower 22. The linear motor 154 is movable between a retracted position and an extended position. In the retracted position the pulley support member 148 is located at approximately the center of the tower 22 and the rotary head 36 is located in the raised position. In the extended position the pulley support member 148 is located near the top 26 of the tower 22 and the rotary head 36 is located in the lower position. During operation of the drilling machine 10, a tension is generated in the pull down cable 124 when the linear motor 154 moves upward to move the rotary head 36 downward forcing the drill string 40 into the ground 16 and a tension is generated in the pull back cable 122 when the linear motor 154 moves downward and the rotary head 36 moves upward lifting the drill string 40 out of the drilled hole.

Tension in the cables 122, 124 of the feed cable subsystem 120 causes the cables 122, 124 to stretch. Cable stretch in one of the cables 122, 124 caused by the tension applied to the cable 122, 124 results in a corresponding slack in the other cable 122, 124. Slack experienced in the cables 122, 124 is disadvantageous because loose cables 122, 124 in a cable and pulley system are likely to disconnect from the pulleys 138, 142, 146, 150, 152 and cause the cable 122, 124 to whip from the pulley 138, 142, 146, 150, 152 when a tension is reapplied to the loose cable 122, 124. In addition to requiring immediate maintenance to repair the feed cable subsystem 120, cable whip is capable of causing injury to vehicle operators and damage to surrounding equipment on the drilling machine 10. The feed cable subsystem 120 prevents loose cables 122, 124 because the slack take-up device 130 removes slack from the pull back cable 122 when the pull down cable 124 experiences elastic stretch.

Figure 8:
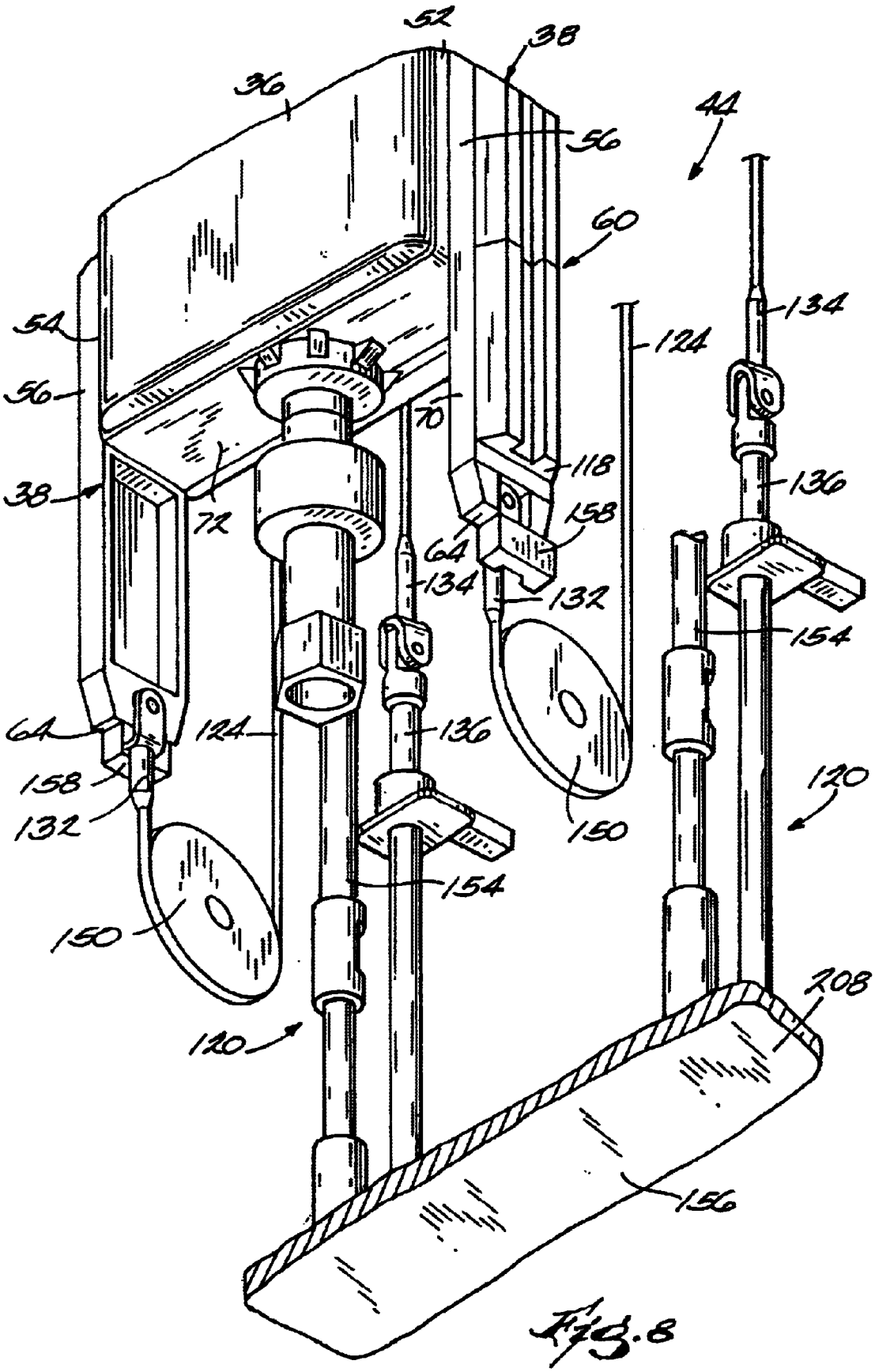
FIG. 8 is an enlarged perspective view illustrating a lower portion of the feed cable system shown in FIG. 6.

Tension in the cables 122, 124 also can create a permanent stretch in the cables 122, 124. Permanent stretch is different from elastic stretch in that elastic stretch allows the cable 122, 124 to return to its original length after the tension is removed from the cable 122, 124. Alternatively, permanent stretch is the amount that the cable 122, 124 remains extended after the tension is removed from the cable 122, 124. Permanent stretch is also disadvantageous because it results in hazardous loose cables 122, 124. As best shown in FIG. 8, the take up device 136 of the feed cable subsystem 120 removes the permanent stretch from the cables 122, 124 to keep the cables 122, 124 taut even after the tension in the cables 122, 124 has been removed. Specifically, the permanent stretch of the cables 122, 124 is removed when the rotary head 36 is moved to the lowermost position such that the rotary head 36 rests against stops 158 that are connected to the bottom 28 of the tower 22. The stops 158 support the rotary head 36 such that the tension in the cables 122, 124 can be removed such that any permanent stretch in the cables 122, 124 appears as slack in the cables 122, 124. At this point, the take up devices 136 are electrically or hydraulically actuated to slowly retract until the cables 122, 124 are pulled taut, thereby removing the slack caused by the permanent stretch.

The slack take-up device 130 is illustrated schematically in FIGS. 9–13. The slack take-up device 130 includes a cylinder 160 and a piston 162 within the cylinder 160 dividing the cylinder 160 into a stem side 164 and an open side 166. The stem side 164 of the cylinder 160 includes a conduit 168 that is in fluid communication between the cylinder 160 and hydraulic fluid that is maintained at a constant pressure. The open side 166 of the cylinder 160 includes an inlet 170 and an outlet 172 which are fluidly connected to a low pressure oil bath 174. The pressure of the oil bath 174 is substantially less than the pressure of the hydraulic fluid so as not to prevent the hydraulic fluid from moving the piston 162. An oil bath 174 is used in the preferred embodiment although valves which allow air to enter and exit the open end of the cylinder 160 could also be used. The oil bath 174 is preferred because the oil prevents corrosion of the piston 162 and cylinder 160 which may be caused by humidity present in the atmosphere. The conduit 168 that connects the hydraulic fluid to the stem side 164 of the cylinder 160 includes a valve 176 that is adjustable between an open position where the hydraulic fluid freely flows into and out of the stem side 164 of the cylinder 160 and a closed position where flow is restricted from exiting or entering the stem side 164 of the cylinder 160.

Figure 9:
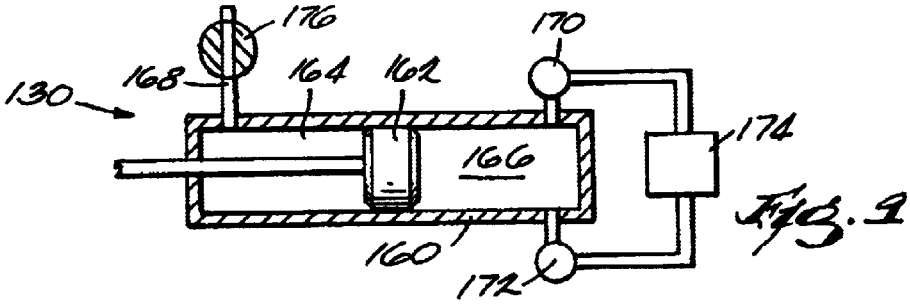
FIGS. 9–13 are schematic views illustrating a slack take-up device of the feed cable system shown in FIG. 5.

FIG. 9 illustrates an equilibrium position where no tension is applied to the pull down cable 124 from the linear motor 154 and therefore no elastic stretch is present in the pull down cable 124 and no corresponding slack is created in the pull back cable 122.

Figure 10:
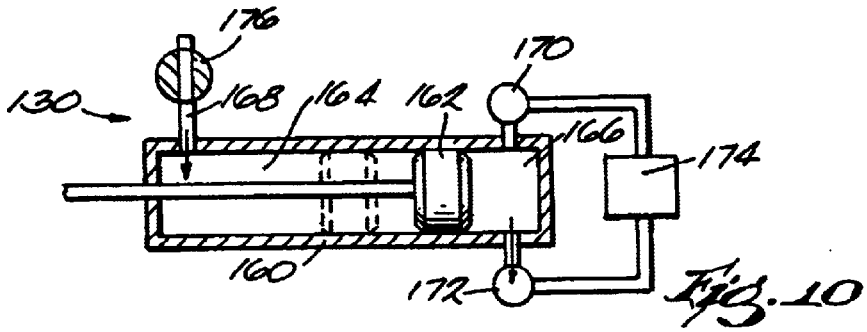

FIG. 10 illustrates the movement of the piston 162 when the linear motor 154 extends to create a tension in the pull down cable 124 in order to drive the drill string 40 into the ground 16. The tension applied to the pull down cable 124 generates a certain amount of stretch in the pull down cable 124 and a corresponding amount of slack in the pull back cable 122. The hydraulic fluid that is supplied to the stem side 164 of the cylinder 160 forces the piston 162 to the right which displaces an equal amount of oil from the open side 166 of the cylinder 160 thereby removing the slack by pulling the pull back cable 122 a distance equal to the slack generated by the stretch in the pull down cable 124.

Figure 11:
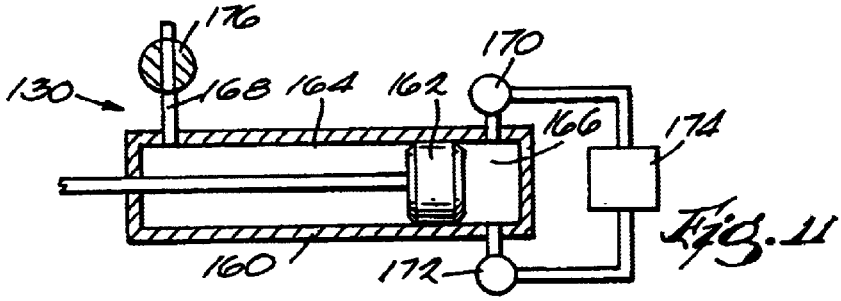

The piston 162 will remain in the position shown in FIG. 11 until the tension changes in the pull down cable 124. For example, if the tension in the pull down cable 124 is increased, the elastic stretch in the pull down cable 124 and slack created in the pull back cable 122 would also increase causing hydraulic fluid to move the piston 162 to the right to remove the additional slack.

Figure 12:
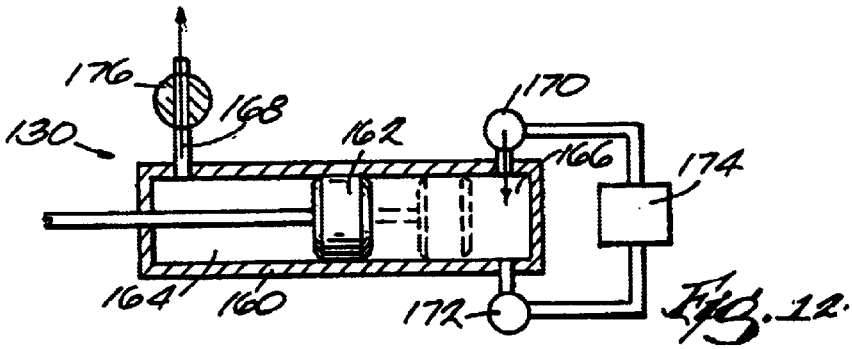

However, if the tension in the pull down cable 124 is removed, the piston 162 will return to the equilibrium position as shown in FIG. 12. The pressure of the hydraulic fluid is not high enough to prevent the pull down cable 124 from returning to its original unstretched length, so the piston 162 will move back to the left forcing the hydraulic fluid out from the stem side 164 of the cylinder 160 and drawing oil into the open side 166 of the cylinder 160.

Figure 13:
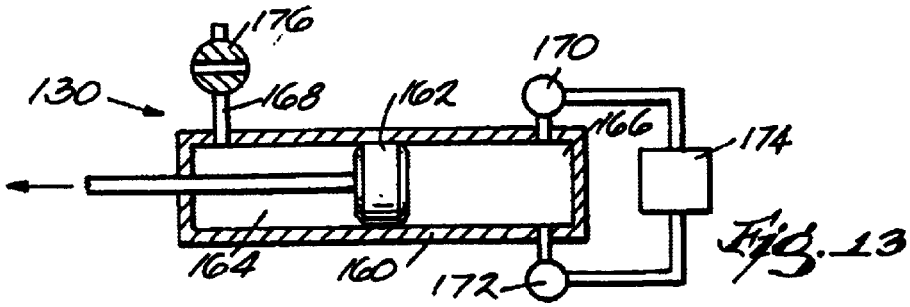

When a tension is applied to the pull back cable 122 by movement of the linear motor 154 as shown in FIG. 13, the valve 176 will close such that no hydraulic fluid can enter or escape the stem side 164 of the cylinder 160 thereby locking the piston 162 the equilibrium position. The valve 176 is connected to a control that determines when the operator activates the controls to move the linear motor 154 in the downward direction. Before the control allows the liner motor 154 to move, the control will shut the valve 176 such that the slack take-up device 130 will operate as a fixed connection.

Figure 14:
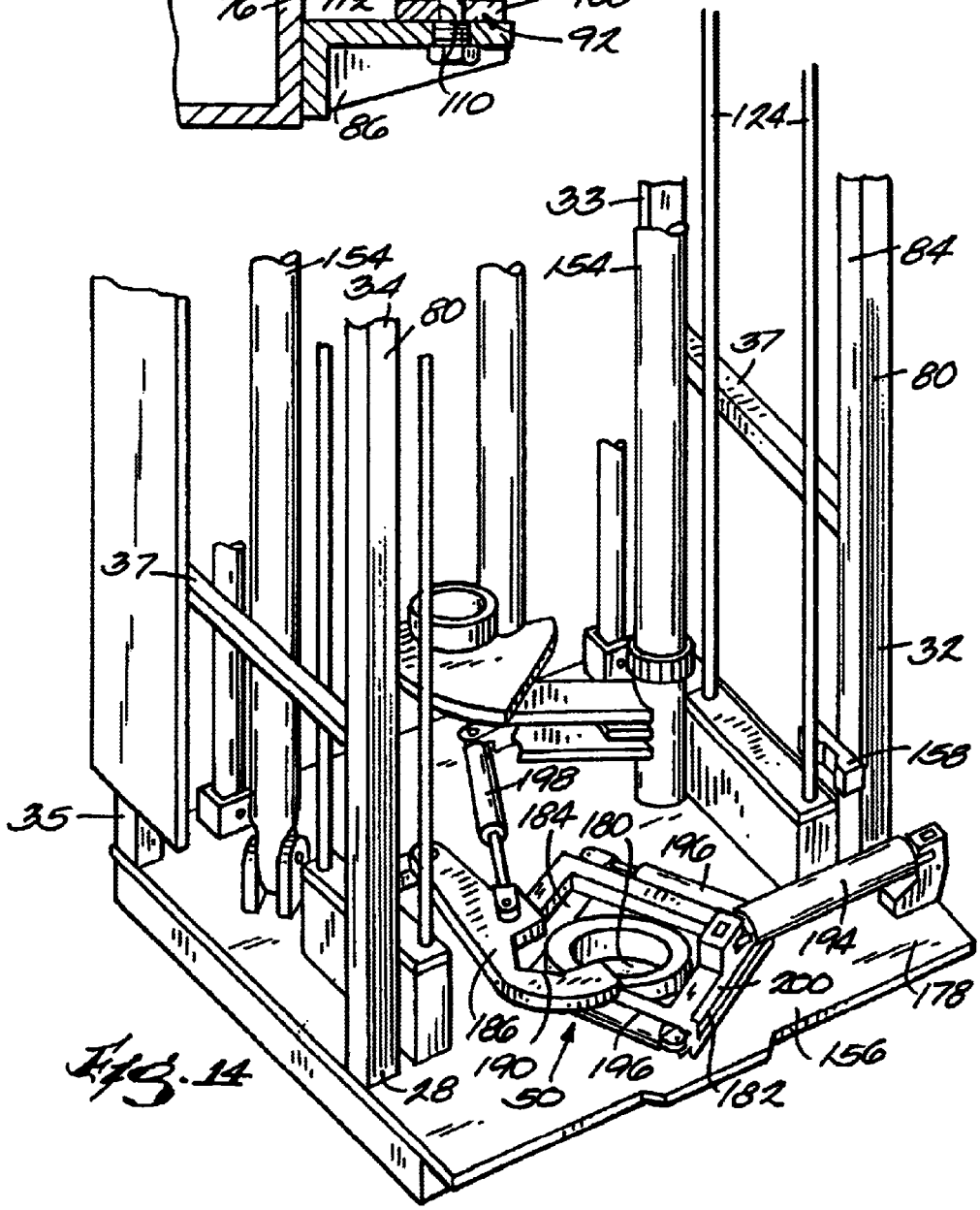
FIG. 14 is an enlarged top perspective view illustrating a non-impact breakout system of the drilling machine shown in FIG. 1.
Figure 15:
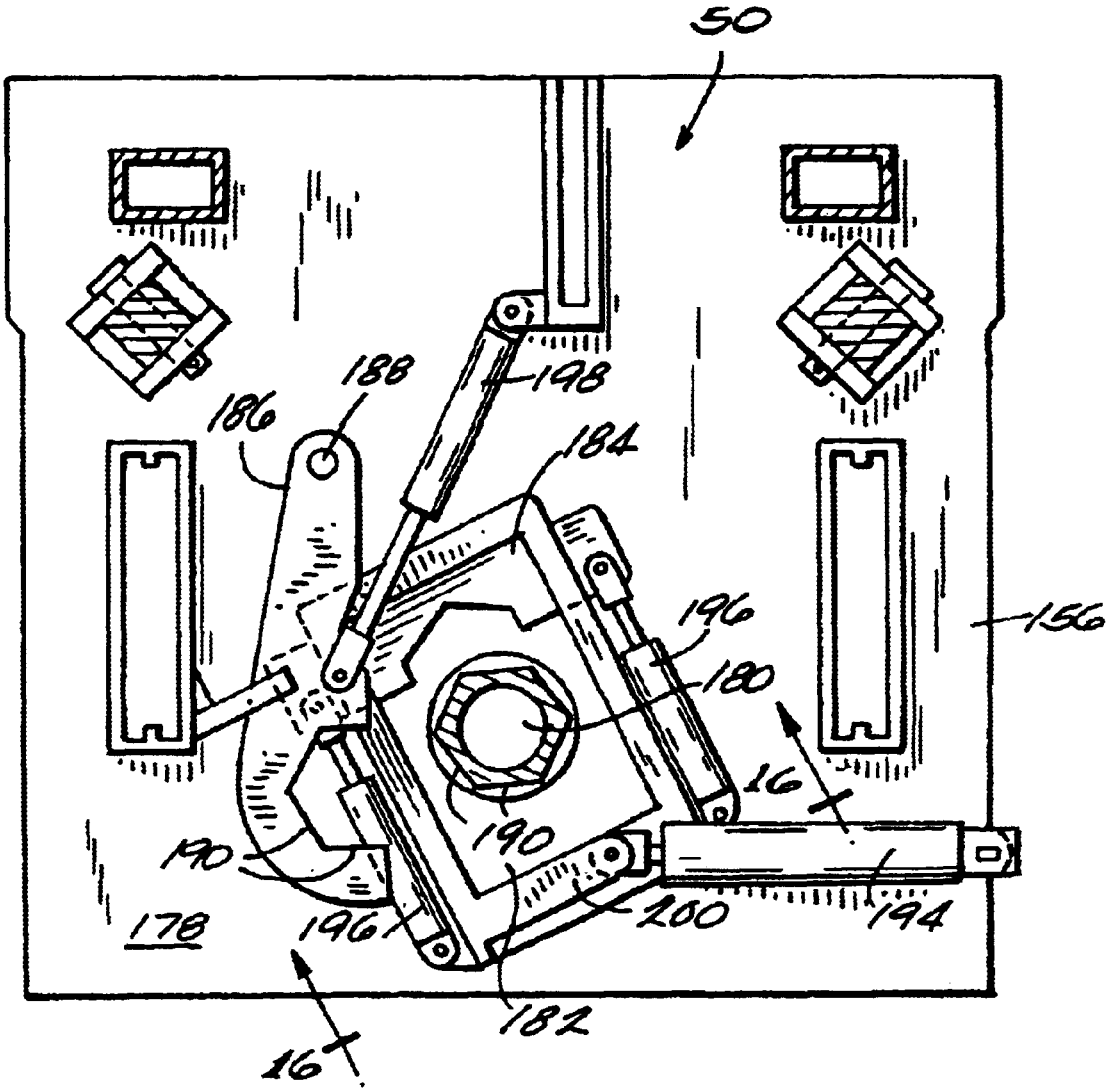
FIG. 15 is a plan view illustrating the operation of the non-impact breakout system shown in FIG. 14.

FIG. 14 is a perspective view and FIG. 15 is a top plan view illustrating the nonimpact breakout system 50. The deck 156 is connected to the bottom 28 of the tower 22 and includes a generally horizontal upper surface 178 and an opening 180 through which the drill string 40 is extendable. The non-impact breakout system 50 includes a base member 182, a lower wrench 184 and an upper wrench 186. The base member 182 is mounted on the deck 156 for pivotal movement relative to the opening 180 in the deck 156. The lower wrench 184 is mounted on the base member 182 for pivotal movement with the base relative to the deck 156, and for translational movement relative to the base member 182. The upper wrench 186 is pivotably coupled relative to the deck 156 for rotation about a rotation axis 188. The upper and lower wrenches 184, 186 include flat surfaces 190 that are engageable with flat surfaces 192 on the drill rods 42. The flat surfaces 190 on the lower wrench 184 and the flat surfaces 190 on the upper wrench 186 are not adjustable, but rather fixed in shape.

The non-impact breakout system 50 also includes a base actuator 194, a pair of lower wrench actuators 196, and an upper wrench actuator 198. The base actuator 194 is pivotably connected to one end 200 of the base member 182 and the deck 156. The base actuator 194 is movable between an extended position and a retracted position such that movement of the base actuator 194 between the extended and retracted positions results in rotation of the base member 182 relative to the deck 156. The pair of lower wrench actuators 196 are connected between the lower wrench 184 and the end 200 of the base member 182. The lower wrench actuators 196 are positioned on opposite sides of the base member 182 and are movable between extended and retracted positions. Extension of the lower wrench actuators 196 moves the lower wrench 184 away from the opening 180 in the deck 156 and retraction of the lower wrench actuators 196 moves the lower wrench 184 toward the opening 180 in the deck 156. The upper wrench actuator 198 is pivotably connected to the upper wrench 186 and the deck 156. The upper wrench actuator 198 is movable between an extended position and a retracted position such that movement of the base actuator 194 between the extended and retracted positions results in rotation of the upper wrench 186 about the rotation axis 188.

Figure 16:
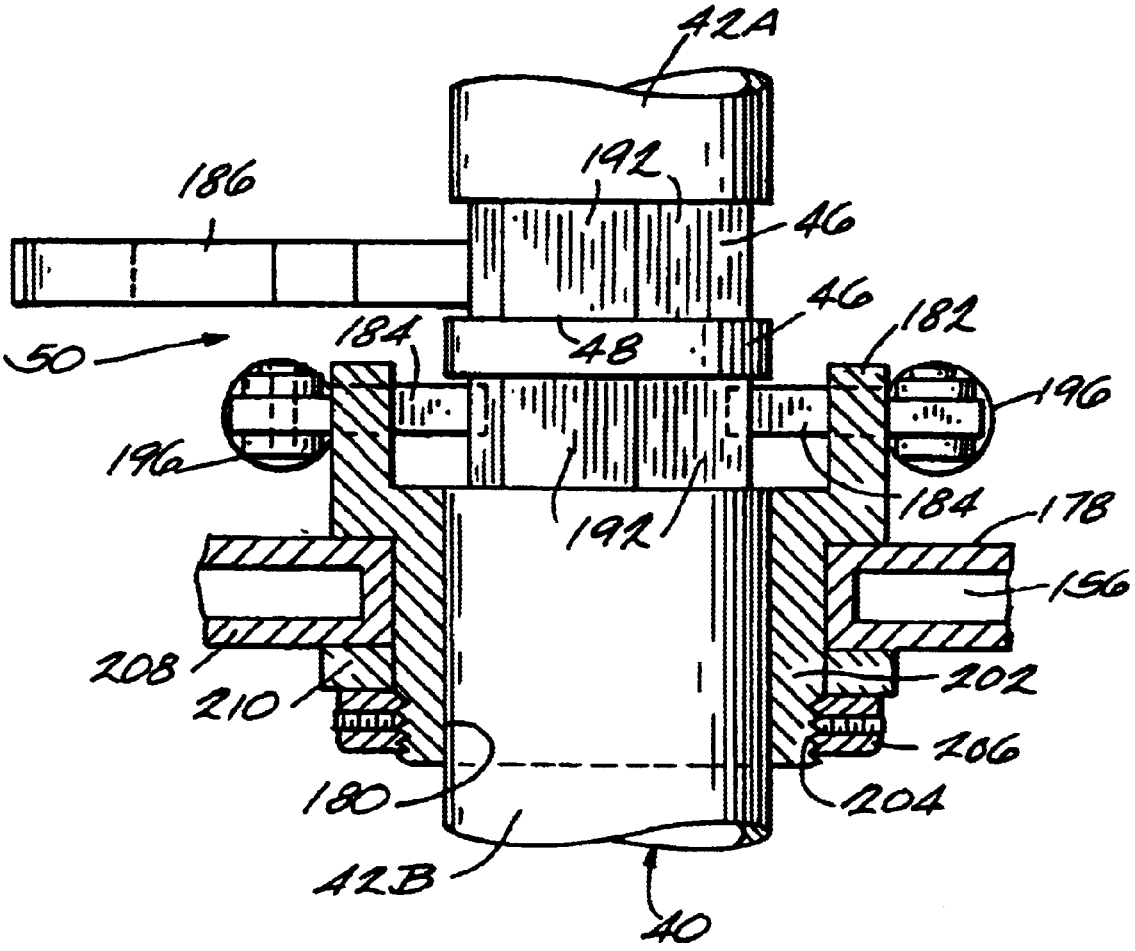
FIG. 16 is a cross section view taken along line 16—16 in FIG. 15.

As shown in FIG. 16, the base member 182 includes a cylindrical portion 202 that is inserted into the opening 180 in the deck 156. The cylindrical portion 202 includes a threaded end 204 that allows a mating fastening ring 206 to be connected to the threaded end 204 such that the fastening ring 206 applies pressure against the bottom surface 208 of the deck 156 through a washer 210 to maintain the base member 182 against the upper surface 178 of the deck 156. FIG. 16 also shows that the flat surfaces 192 of the upper drill rod 42A are engageable by the upper wrench 186 and that the flat surfaces 192 of the lower drill rod 42B are engageable by the lower wrench 184.

Figure 17:
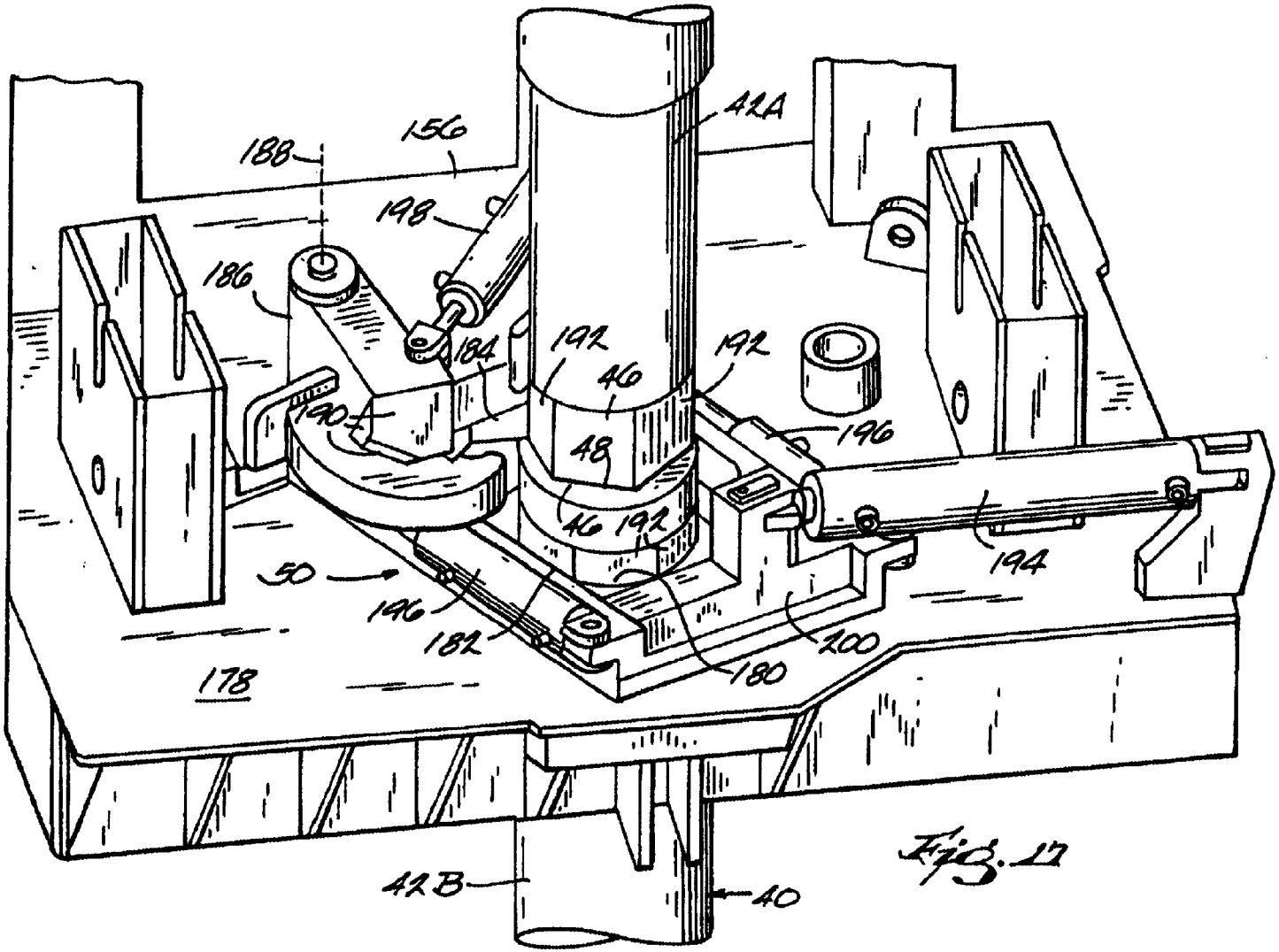

FIGS. 17–21 illustrate the operation of the non-impact breakout system 50 to break a joint 48 between an upper drill rod 42A and a lower drill rod 42B. In FIG. 17, the drill string 40 extends through the opening 180 in the deck 156 such that the flat surfaces 192 on the upper portion of the lower drill rod 42B are just above the upper surface 178 of the deck 156 and the flat surfaces 192 on the lower portion of the upper drill rod 42A are slightly above the base member 182. The upper wrench actuator 198 is in the extended position such that the upper wrench 186 is disengaged with the flat surfaces 192 on the upper drill rod 42A, the lower wrench actuators 196 are in the extended position such that the lower wrench 184 is disengaged with the flat surfaces 192 on the lower drill rod 42B, and the base actuator 194 is retracted such that the base member 182 is rotated fully counterclockwise (as viewed in FIG. 15).

Figure 18:
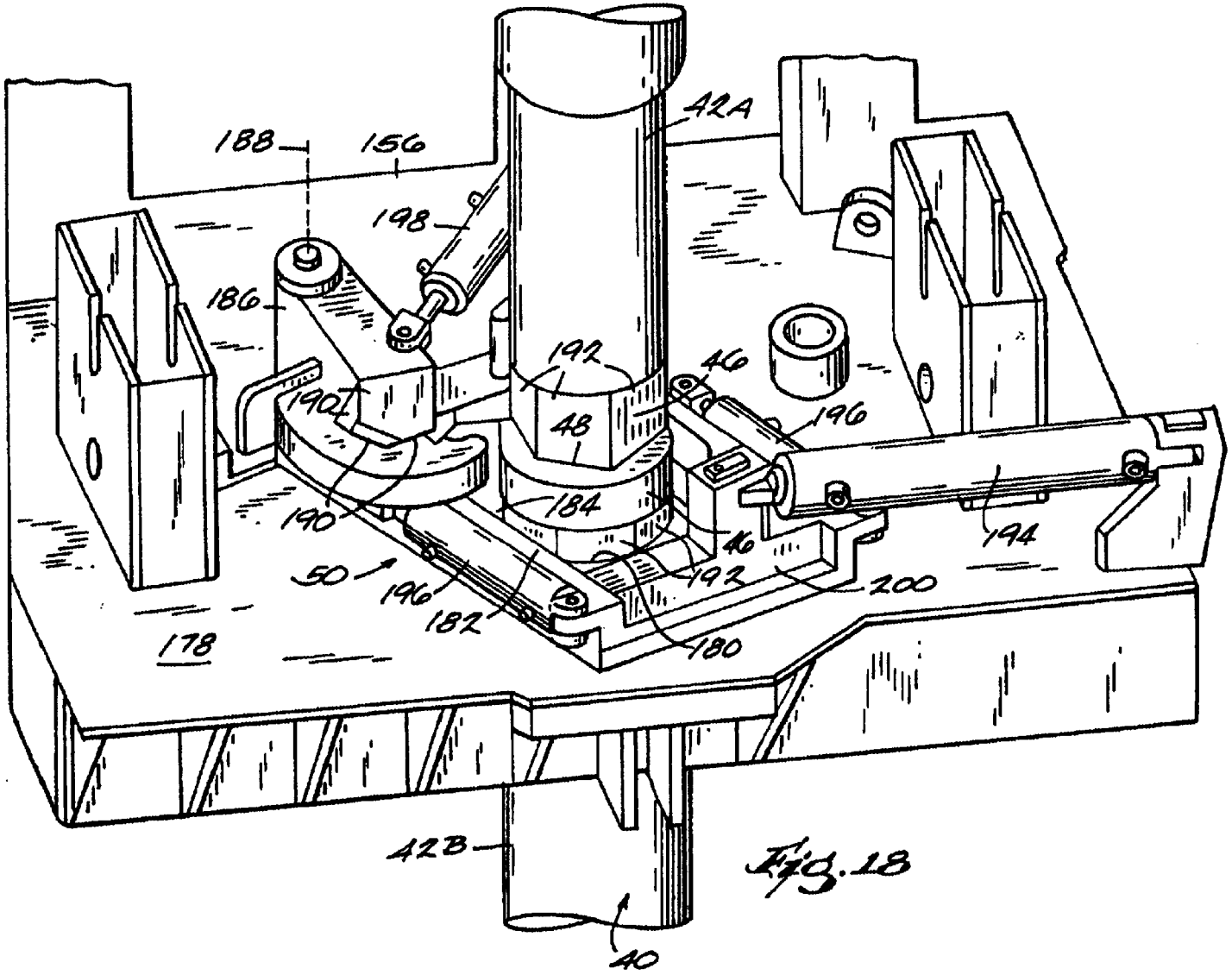
Figure 12:
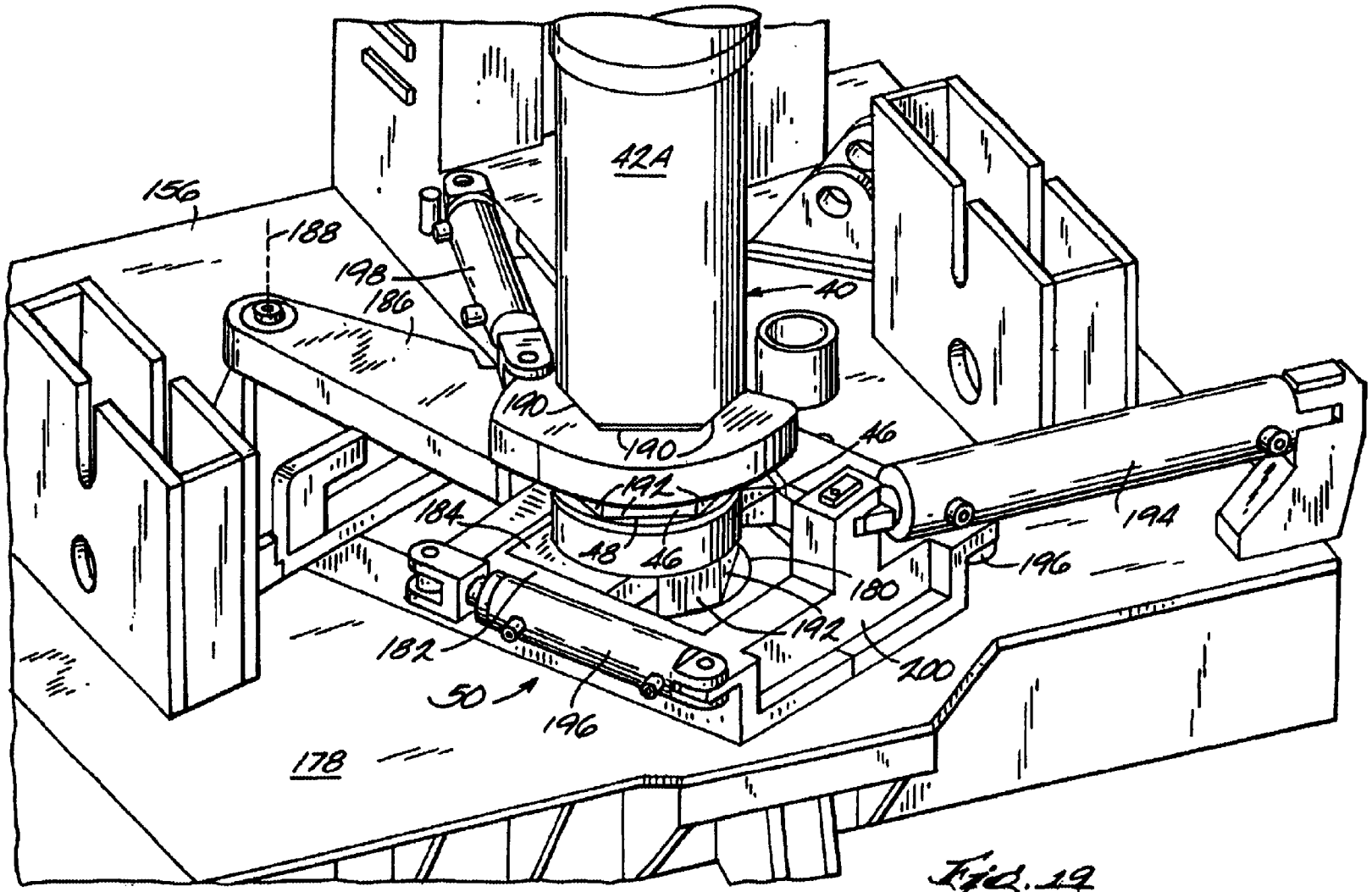

Prior to engaging the flat surfaces 192 of the lower drill rod 42B with the lower wrench 184, the flat surfaces 192 are aligned with flat surfaces 190 on the lower wrench 184 by either rotating the rotary head 36 and the drill string 40, or by slightly extending the base actuator 194 such that the base member 182 and the lower wrench 184 rotate relative to the stationary drill string 40. Once the flat surfaces 190 on the lower wrench 184 are properly aligned with the flat surfaces 192 on the lower drill rod 42B, the lower wrench actuators 196 are retracted such that the lower wrench 184 engages the flat surfaces 192 of the lower drill rod 42B as shown in FIG. 18.

Next, the base actuator 194 is slightly extended to align the flat surfaces 192 of the upper drill rod 42A with the flat surfaces 190 on the upper wrench 186. Once the flat surfaces 190, 192 are aligned as shown in FIG. 19, the upper wrench actuator 198 is retracted such that the upper wrench 186 is pivoted into engagement with the flat surfaces 192 of the upper drill rod 42A.

Figure 20:
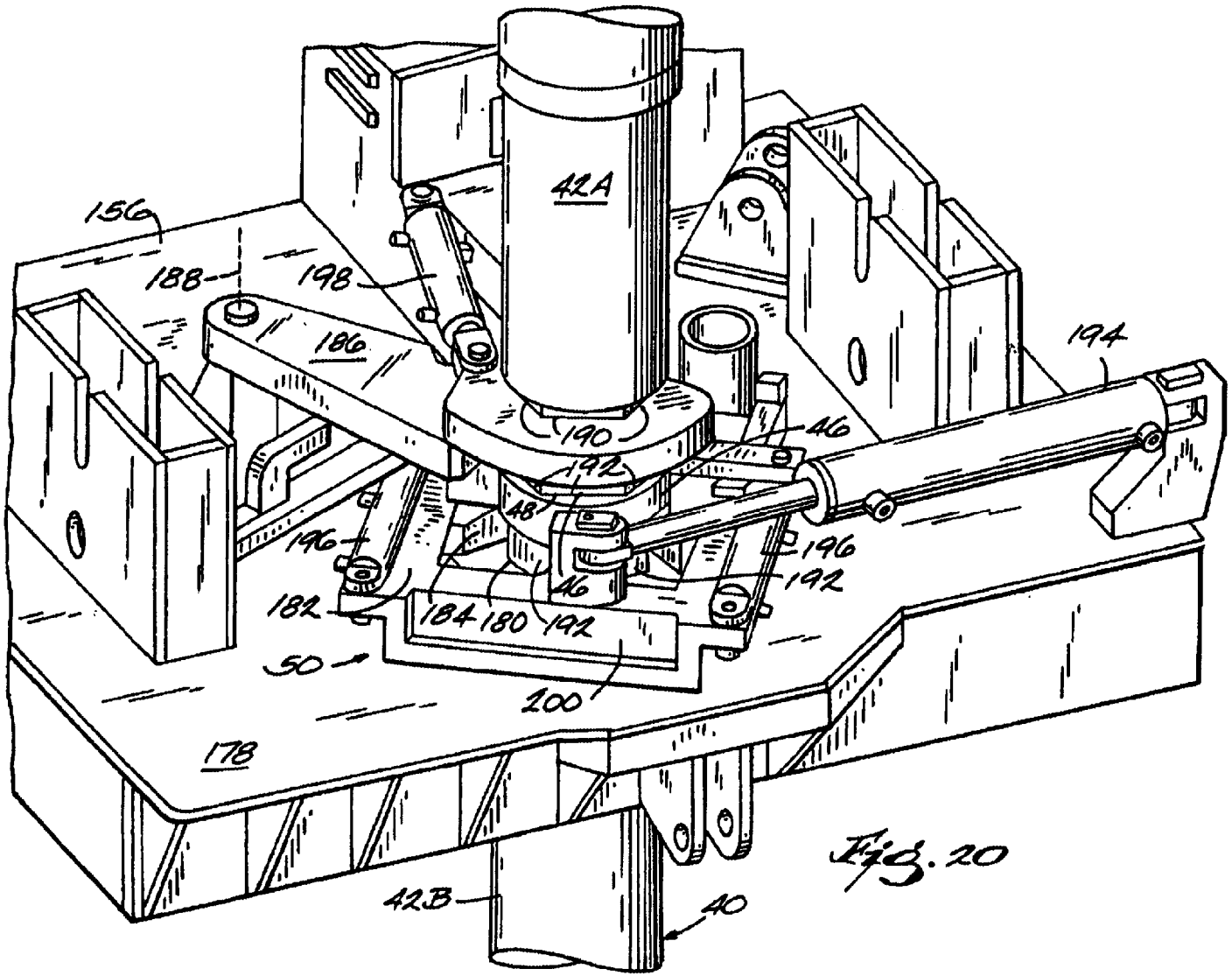

As shown in FIG. 20, the base actuator 194 is then fully extended to rotate lower wrench 184 and the lower drill rod 42B relative to the upper wrench 186 that holds the upper drill rod 42A stationary with respect to the deck 156. This series of movements successfully breaks the joint 48 between the upper and lower drill rods 42A, 42B. The non-impact breakout system 50 maintains the integrity of the exterior surface of the drill rods 42 because it engages flats on the drill rods 42 instead of using teeth that engage the surfaces of the drill rods 42. The breakout system 50 also improves the overall effectiveness by consistently providing the necessary torque to break the joint 48 between the upper and lower drill rods 42A, 42B.

Figure 21:
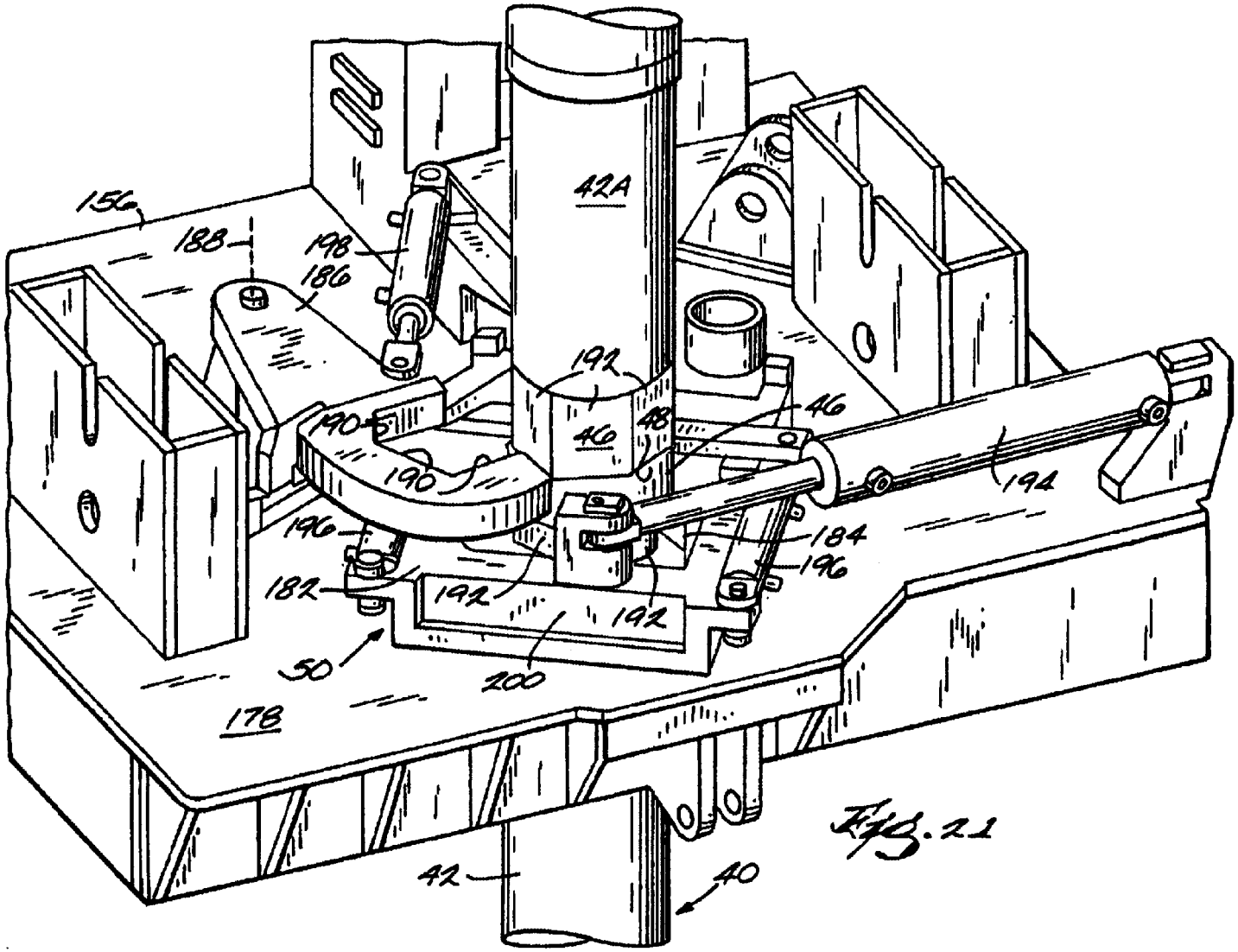

With reference to FIG. 21, to complete the disconnection and removal of the upper drill rod 42A the upper wrench actuator 198 is once again extended to disengage the upper wrench 186 from the flat surfaces 192 of the upper drill rod 42A. While keeping the flat surfaces 192 of the lower drill rod 42B engaged with the lower wrench 184, the rotary head 36 rotates the upper drill rod 42A in a reverse direction while the lower wrench 184 holds the lower drill rod 42B stationary with respect to the deck 156, such that the upper drill rod 42A completely unscrews from the lower drill rod 42B. After the upper drill rod 42A is disconnected from the lower drill rod 42B, the upper drill rod 42A is disconnected from the rotary head 36 and then removed from the drill string 40. The rotary head 36 is then connected to the lower drill rod 42B and the entire joint breaking process is repeated until the entire drill string 40 is disassembled.

I claim:

1. A drilling machine for use with a drill string, the drilling machine comprising a frame supported for movement over the ground, a tower mounted on the frame, a rotary head movable along the tower, the rotary head being engageable with the drill string for rotating the drill string, a pull down cable connected to the rotary head for pulling the rotary head downward relative to the tower for pushing the drill string into the ground, a pull back cable connected to the rotary head for pulling the rotary head upward relative to the tower for pulling the drill string out of the ground, the pull back cable being subject to a slack condition in response to elastic stretch of the pull down cable, and a slack take-up device connected to the pull back cable to automatically remove the slack created in the pull back cable by the elastic stretch of the pull down cable.

2. A drilling machine as set forth in claim 1 wherein the frame is supported by crawlers.

3. A drilling machine as set forth in claim 1 wherein the tower is movable relative to the frame between a substantially vertical position and a non-vertical position.

4. A drilling machine as set forth in claim 1 and further comprising an operator station on the frame.

5. A drilling machine as set forth in claim 1 wherein the pull down and pull back cables have respective first ends connected to the tower and respective second ends connected to the rotary head, and wherein the pull down and pull back cables are reeved around respective pulleys movable relative to the tower to cause movement of the rotary head.

6. A drilling machine as set forth in claim 5 wherein the pulleys are mounted on a pulley support member, and further comprising a linear motor for moving the pulley support member relative to the tower to cause movement of the rotary head.

7. A drilling machine as set forth in claim 6 wherein movement of the pulley support member in one direction creates tension in the pull down cable to pull the rotary head downward, and wherein movement of the pulley support member in the opposite direction creates tension in the pull back cable to pull the rotary head upward.

8. A drilling machine as set forth in claim 6 wherein the linear motor is a cylinder/piston assembly.

9. A drilling machine as set forth in claim 5 wherein the slack take-up device is connected between the tower and the first end of the pull back cable.

10. A drilling machine as set forth in claim 5, wherein the slack take-up device is a cylinder/piston assembly.

11. A drilling machine as set forth in claim 10, wherein the cylinder/piston assembly is supplied with constant pressure to remove the slack in the pull back cable by providing the pull back cable with constant tension.

12. A drilling machine as set forth in claim 11 wherein the pull down cable has a stretched condition when a first pulling force is applied to the pull down cable and an unstretched condition when the first pulling force is removed from the pull down cable, and wherein the constant tension provided by the cylinder/piston assembly allows the pull down cable to return to the unstretched condition from the stretched condition.

13. A drilling machine as set forth in claim 12, wherein the cylinder/piston assembly extends to an equilibrium position when the first pulling force is removed from the pull down cable and locks in the equilibrium position when a second pulling force is applied to the pull back cables.

14. A drilling machine as set forth in claim 12 further comprising a take up device connected between the tower and the first end of the pull down cable, wherein the pull back cable has a stretched condition when a second pulling force is applied to the pull back cable and an unstretched condition when the second pulling force is removed from the pull back cable, the take up device adapted to remove the slack caused by permanent stretch of the pull down and pull back cables when the pull down and pull back cables are in the unstretched condition.

15. A drilling machine as set forth in claim 14 wherein the take up device is one of a hydraulic and an electric jack-screw.

16. A drilling machine as set forth in claim 1 wherein the slack take up device automatically returns the slack to the pull back cable when the pull down cable returns to an unstretched condition.

17. A drilling machine for use with a drill string, the drilling machine comprising a frame supported for movement over the ground, a tower mounted on the frame, a rotary head movable along the tower, the rotary head being engageable with the drill string for rotating the drill string, a pull down cable connected to the rotary head for pulling the rotary head downward relative to the tower for pushing the drill string into the ground, a pull back cable connected to the rotary head for pulling the rotary head upward relative to the tower for pulling the drill string out of the ground, the pull back cable being subject to a slack condition in response to elastic stretch of the pull down cable, wherein the pull down and pull back cables have respective first ends connected to the tower and respective second ends connected to the rotary head, and wherein the pull down and pull back cables are reeved around respective pulleys movable relative to the tower to cause movement of the rotary head and a slack take-up device connected to the tower and the first end of the pull back cable to remove the slack created in the pull back cable by the elastic stretch of the pull down cable, wherein the slack take-up device is a cylinder/piston assembly that is supplied with constant pressure to remove the slack in the pull back cable by providing the pull back cable with constant tension, wherein the pull down cable has a stretched condition when a first pulling force is applied to the pull down cable and an unstretched condition when the first pulling force is removed from the pull down cable, wherein the constant tension provided by the cylinder/piston assembly allows the pull down cable to return to the unstretched condition from the stretched condition, and wherein the cylinder/piston assembly extends to an equilibrium position when the first pulling force is removed from the pull down cable and locks in the equilibrium position when a second pulling force is applied to the pull back cables.

18. A drilling machine for use with a drill string, the drilling machine comprising a frame supported for movement over the ground, a tower mounted on the frame, a rotary head movable along the tower, the rotary head being engageable with the drill string for rotating the drill string, a pull down cable connected to the rotary head for pulling the rotary head downward relative to the tower when a first pulling force is applied to the pull down cable for pushing the drill string into the ground, a pull back cable connected to the rotary head for pulling the rotary head upward relative to the tower when a second pulling force is applied to the pull back cable for pulling the drill string out of the ground, the pull back cable being subject to a slack condition in response to elastic stretch of the pull down cable when the first pulling force is applied to the pull down cable, and a slack take-up device connected to the pull back cable and defining an equilibrium position when no pulling forces are applied to the pull down and pull back cables, wherein the slack take-up device moves from the equilibrium position to automatically remove the slack created in the pull back cable by the elastic stretch of the pull down cable when the first pulling force is applied to the pull down cable, wherein the slack take-up device returns to the equilibrium position to automatically return the slack to the pull back cable when the first pulling force is removed from the pull down cable returning the pull down cable to an unstretched condition, and wherein the slack take-up device locks in the equilibrium position when the second pulling force is applied to the pull back cables.

* * * * *